United States Patent [19]

Woelffer

[11] 4,108,120

[45] Aug. 22, 1978

[54] GOVERNOR CONTROL FOR AN INTERNAL COMBUSTION ENGINE

[75] Inventor: Neill Carl Woelffer, Racine, Wis.

[73] Assignee: Jacobsen Manufacturing Company, Racine, Wis.

[21] Appl. No.: 771,927

[22] Filed: Feb. 25, 1977

[51] Int. Cl.[2] ..... F02D 11/02; F02D 11/08

[52] U.S. Cl. ..... 123/103 B

[58] Field of Search ..... 123/103 R, 103 B, 103 C, 123/103 E; 180/108

[56] References Cited

U.S. PATENT DOCUMENTS

| | | | |
|---|---|---|---|
| 1,639,265 | 8/1927 | Miller | 123/103 C |
| 1,822,473 | 9/1931 | Brandl et al. | 123/103 B |
| 1,917,790 | 7/1933 | Baumann | 123/103 B |
| 2,529,242 | 11/1950 | Brown et al. | 123/103 B X |
| 2,836,159 | 5/1958 | Morden | 123/103 B |
| 2,935,977 | 5/1960 | Eberline | 123/103 B X |

*Primary Examiner*—Carlton R. Croyle
*Assistant Examiner*—Michael Koczo, Jr.
*Attorney, Agent, or Firm*—Arthur J. Hansmann

[57] ABSTRACT

A governor control for an internal combustion engine of the type wherein air is blown in the operation of the engine to move an air vane connected with the throttle plate for throttling the engine. An operator-controlled handle is movably mounted and interconnects with the air vane through a spring and a flexible cable, all for placing spring tension on the air vane to resist the blowing by the engine and thus govern the engine's speed. A movable stop member is operative on the handle and is spring urged so that the handle can be set in normal engine speed positions and thus cause the engine to run slow or fast, and the handle can also be set in an overriding and spring-urged position to cause the engine to run faster and the spring will automatically return the handle to the fast engine speed position when the operator releases the handle.

11 Claims, 5 Drawing Figures

GOVERNOR CONTROL FOR AN INTERNAL COMBUSTION ENGINE

This invention relates to a governor control for an internal combustion engine, and, more particularly, it relates to a governor control for engines of the small size which utilize air vanes connected to the throttle plate and blown by the engine blower itself, all for automatic governing of the engine speed.

BACKGROUND OF THE INVENTION

The prior art is already aware of arrangements for governing engine speed in small gasoline types of engines, and these arrangements commonly utilize an air vane positioned to be under the influence of the air blown by the engine blower. That is, when the engine is running fast or faster than actually desired, then the air vane will be blown and will impose its movement upon the throttle plate to thereby move the throttle plate toward a closed position and thus reduce the engine speed. This of course is an automatic type of governor, and it is commonly used in the industry today and serves the purpose for reducing engine speed when there is no load or only a light load on the engine and the engine would therefore tend to run fast. Conversely, when there is an increase in the load on the engine, then the engine speed is slowed down and thus the force of the air blown against the air vane is reduced and in turn the air vane moves and controls the position of the engine throttle plate to move it toward an open position so that the engine can sustain its speed under load. Examples of the aforementioned type of prior art constructions are only generally and broadly disclosed in U.S. Pat. Nos. 2,297,897 and 2,529,242 and 2,548,334 and 2,836,159 and 3,104,657 and 3,326,196. The prior art is also aware of carburetor or engine types of governors which do not utilize the air vane, and one isolated example is shown in U.S. Pat. No. 2,837,070.

In the prior art, the engine speed is governed within a normal range of speed such that the governing is done automatically to have the engine sustain its speed within a normal range even though the engine is subjected to variations in load. Of course in these prior art arrangements, throttle levers are provided so that the operator can set the lever at say a mid-position of an overall range selection of engine speed, and the engine will tend to retain its speed at that position and will automatically counter the tendencies to vary the speed according to the load or no load on the engine. For example, a small gasoline engine used for a lawn mower may have a throttle lever setting of a range which will permit the engine to run from a low speed up to a speed of as high as 3200 revolutions per minute. However, there are instances where the operating conditions, such as the load on the engine, are such that it would be desirable to run the engine slightly faster for a short time and under unusual load conditions or the like. Accordingly, it is an object of this invention to provide an engine governor control which will permit the heretofore arrangement and function of the governing of the engine through its normal running range and which will also permit the additional upper speed for the engine. In accomplishing this objective, the present invention provides a governor control which permits the usual throttle lever use and manipulation for the normal range of engine speeds and which superimposes upon the control mechanism the arrangement for the additional or increased engine speed, all achieved through a control lever, and with the arrangement being such that, upon release of the control lever when it has once been placed in the range for the additional or super speed, the control lever will automatically return to its normal range position.

Accordingly, the present invention provides an improvement upon the heretofore known engine governor controls, and it utilizes the basic arrangement of the control known in the prior art and it superimposes upon that type of control an additional arrangement and feature so that the maximum performance and top speed can be obtained from the engine when such is desired.

The present invention therefore also provides an engine governor control which incorporates, a control lever or handle which controls the engine functions for stopping the engine and running the engine slowly and running the engine at intermediate speeds and running the engine at a fast speed and running the engine at a super-fast speed. As mentioned, all of these aforesaid engine conditions are achieved through the governor control of this invention and through the use of a throttle control lever or handle. Therefore, compared to the prior art, this invention provides an arrangement whereby there can be an instant increase in the governed engine speed and available power, and that is achieved upon actuation of the throttle control handle and it has an automatic return to a present condition, all while retaining the normal throttle control positions of that handle and the normal functions of the throttle as commonly utilized in the aforesaid prior art. Accordingly, the present invention accomplishes all of these functions through the utilization of a throttle control lever and no external or additional mechanisms are required for that type of control. That is, the present invention does not require any mechanism for spring-loading the throttle itself, and that would be the arrangement whereby the throttle lever is under the influence of a spring which overrides the governor mechanism.

Other objects and advantages will become apparent upon reading the following description in light of the accompanying drawings.

DETAILED DESCRIPTION OF THE PREFERRED EMBODIMENTS

Figures 1, 2, 3, 4, 5:
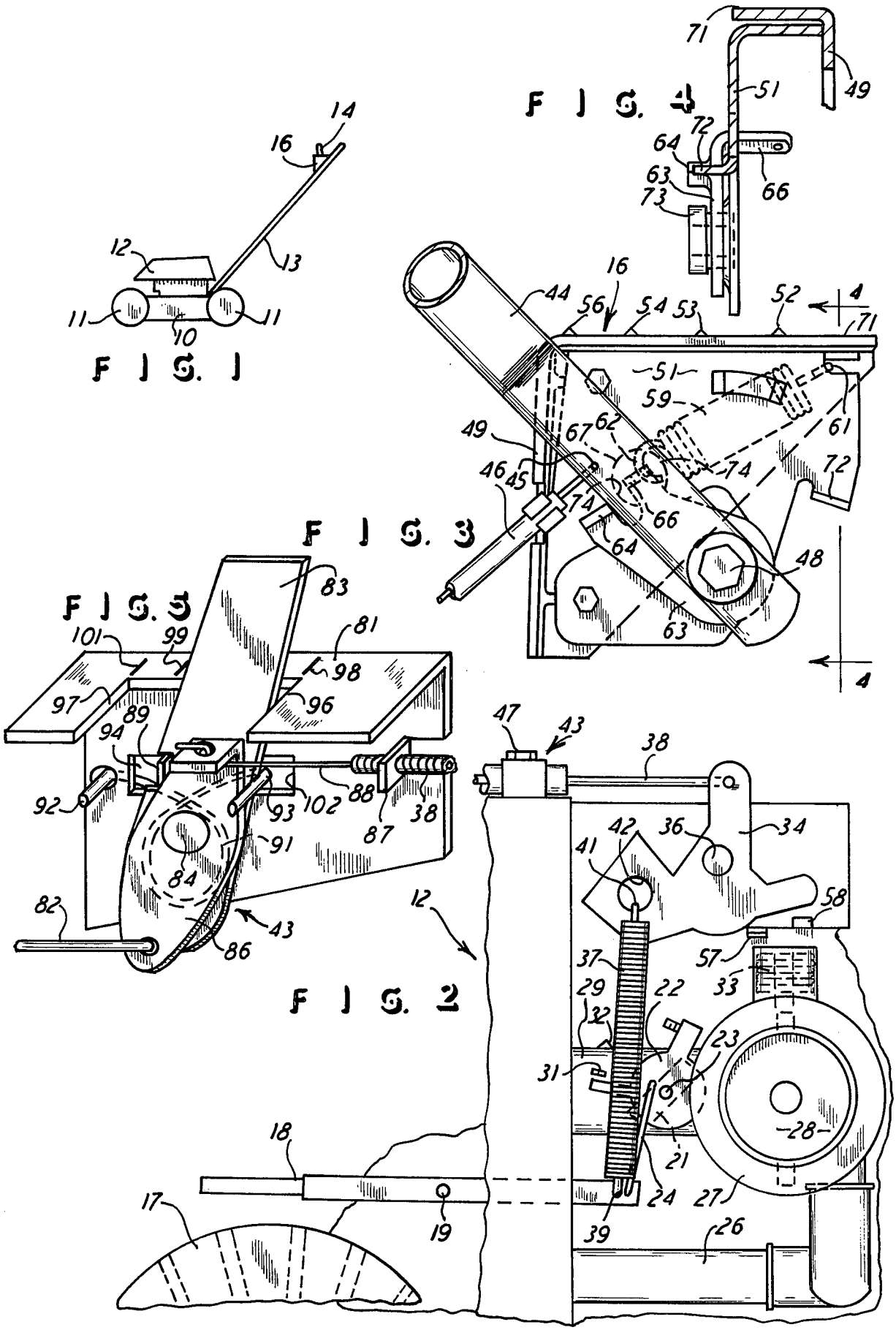
FIG. 1 is a side elevational view of a lawn mower having a small gasoline engine and showing one embodiment of the elements of the governor control of this invention.
FIG. 2 is an enlarged top plan view of a fragment of the engine and governor control which is utilized in FIG. 1.
FIG. 3 is an end elevational view of another fragment of the governor control utilized in FIG. 1.
FIG. 4 is a sectional view taken along the line 4—4 of FIG. 3.
FIG. 5 is a perspective view of another embodiment of this invention.

FIG. 1 shows a rotary type of lawn mower having a conventional housing 10 and ground-engaging wheels 11 and a gasoline or internal combustion engine designated 12. Also, a guide handle 13 is suitably affixed as a part of the mower to extend therefrom for control by the operator, and the arrangement is in the general and well-known manner of providing a rotary type lawn mower of the type commonly in use today. FIG. 1 also shows a control handle 14 and a mounting block or portion 16, and the handle 14 is pivotally mounted to serve as a throttle control and the arrangement is shown in more detail in FIG. 3.

FIG. 2 shows a plan view of a fragment of the engine and particularly the carburetor portion thereof. The usual engine blower 17 is fragmentarily shown, and the self-responsive member or air vane 18 is pivotally mounted adjacent the blower 17 on a pin 19, and the end of the vane member 18 is suitably connected with the engine throttle plate 21 by means of the pivot plate 22 pivotally mounted on the pin 23. Thus, in the usual arrangement, operation of the engine will cause the blower 17 to rotate and blow the air against the vane 18 and thus pivot the vane to in turn pivot the throttle plate 21 through the interconnection with the link 24 suitably connected to the pivot plate 22 which is attached to the throttle plate 21 for pivoting the latter. Also in the usual arrangement, the gasoline line 26 extends to the intake member 27 which supports the usual choke plate 28, and the gasoline line 29 extends therefrom and into the engine, all in the usual arrangement. Thus, gasoline flowing from the unshown gasoline tank and through the pipe 26 moves into the member 27 and past the throttle plate 21 and into the pipe 29 and thus to the engine for running the engine, all in accordance with the open or closed position of the throttle plate 21, in the usual manner. The throttle plate 21 may be operative against abutments 31 and 32 to thus limit the open and closed positions of the throttle plate 21 in a mechanical arrangement of limiting. Also, the usual choke plate 28 can be controlled by a spring 33 suitably attached to the plate 28 for opening and closing the plate according to the temperature of the spring 33 which reflects the temperature of the engine itself, in the usual arrangement.

Another pivotally mounted control plate 34 is pivoted on a pin 36 and interconnects with a tension spring 37 and a control wire 38, as shown. Thus the spring 37 is of the coil spring type and has one end 39 connected with an end of the self-responsive member 18, and the spring 37 has its other end 41 connected in an enlarged opening 42 in the pivot plate 34. Thus, FIG. 2 generally shows the spring 37 in a free-body position where the effective length of the spring 37 is at least that of the space between the connection points of the spring ends 39 and 41 on the members 18 and 34, respectively. With that arrangement, the spring 37 can actually act as a link member and can force against the member 18 to thus pivot the member 18 clockwise, as viewed in FIG. 2, when the spring 37 is sufficiently positioned to move toward the member 18 to create the clockwise pivoting mentioned. In that instance, the throttle plate 21 is thus moved toward a closed position as the plate 21 moves toward a transverse position in its gas line 29, and that is created by the link 24 responding to the movement of the member 18 and imposing that movement on the pivot plate 22 which in turn moves the throttle plate 21 to the interconnection between the plate 22 and the throttle plate 21.

The pivot plate 34 is under the influence of the wire or connector 38 which is a part of the operator controlled mechanism generally designated 43 and including the plate 34 and the wire 38 and the operator controlled handle or lever 44. Thus, the wire 38 is a part of the usual cable and wire arrangement of the Bowden type, and its one end is shown in FIG. 2 and its other end 45 extends into the handle 44 to connect and move therewith, and is designated 46, as shown in FIG. 3, and this wire or interconnector is thus continuously extending and connected between the pivot plate 34 and the throttle lever or handle 44, and thus the Bowden wire extends along the lawn mower handle 13 from that handle or throttle control designated 14 in FIG. 1 and down to the engine 12, as mentioned in FIG. 1. Accordingly, the wire or interconnector end 46 is suitably secured by means of a screw 47 to the engine 12, and thus the wire 38 can slide through its surrounding casing and thus induce the desired pivoted position of the pivot plate 34 and correspondingly alter the tension in the tension spring 37 to thereby counter the clockwise pivotal movement of the vane member 18 under the influence of the air blown by the engine blower 17.

FIG. 3 shows the throttle lever 44 to be pivotally mounted by means of the bolt 48, and thus the lever 44 can pivot in the fore-and-aft direction of the mower and thereby cause the wire 38 to extend and contract relative to the pivot plate 34 and to induce the desired pivotal movement of the plate 34 about its pivot pin 36. The member 16 is shown in FIG. 3 and it includes the base member 49 and the cover plate 51, and the bolt 48 extends through these members and also extends through the mower handle 13 for securing these members to the mower handle 13, in a suitable arrangement. The base member 49 is provided with indicia or markings designated 52, 53, 54, and 56, and these markings can respectively represent an engine condition of "stop" and "slow" and "fast" and "super" or "faster". That is, when the throttle handle 44 is in a pivoted position about its pivot bolt 48 to correspond to any one of the four positions just described, then the engine 12 will be operating in accordance with that selected one of the four positions described. Therefore, if the handle 44 were fully retracted by the operator to relate to the position designated 52, that being the "stop" position, then the wire 38 would have been retracted to where the plate 34 would rotate counterclockwise and permit the plate 34 to engage the stop blade 57 which is of the usual type and which would therefore cause the engine to short and thereby stop, all in the usual and well-known arrangement. Secondly, if the handle 44 were placed in the position relating to that designated 53, then the plate 34 would be positioned so that the tension in the spring 37 would be such that the member 18 and thus the throttle plate 21 would be positioned for a slow speed of the engine 12, and of course that would mean that the throttle plate 21 would be slightly away from a fully closed position. In that position, if the engine 12 is running with a light or no load, then the vane member 18 will be heavily blown by the engine blower 17 and that will tend to cause the member 18 to pull on the spring 37 and to tend to rotate the throttle plate 21 toward the closed position. However, the spring 37 will resist the tendency for the member 18 to rotate clockwise, as seen in FIG. 2, and thus the throttle plate 21 will be retained in a governed position for desirably governing the speed of the engine 12, in the usual arrangement. Next, if the handle 44 is placed in a position corresponding to that position designated 54, then the engine speed would be at a fast speed, since the pivot plate 34 would have been further pivoted in the clockwise direction to place further tension in the spring 37 and thus to even further resist the movement of the vane member 18 and the corresponding tendency to close the throttle plate 21.

This particular invention provides the arrangement for the throttle position designated 56, and that is the super speed position, and in that position the plate 34 would be rotated to its maximum position and this could be where the plate abuts a stop 58, and there is then a maximum tension in the spring 37 and thus a maximum resistance to the closing of the throttle plate 21. However, in that position designated 56, the throttle member or handle 44 is under the influence of a tension spring 59, and thus the operator must move the handle 44 from the position 54 and to the position 56 against the tension of the spring 59; and, correspondingly, when the operator releases pressure on the handle 44, then the handle 44 will automatically return from the position 56 and to the position 54, all by virtue of the force of the spring 59. Therefore, the spring 59 has one end 61 anchored in the plate 51, and it has its other end 62 anchored with a pivotal stop member 63 which is pivoted on the axis of the bolt 48, and the stop member 63 has one offset or leg 64 extended into the path of the lever 44, and it has another offset or leg 66 extended inwardly and into a circular opening 67 in the plate 51. As such, the stop member has its leg 66 limited by the confines of the circular opening 67 which serves as abutments for the pivotal movement of the member 63. That is, the leg 66 extends into the opening 67 and can move only through the diameter of the opening 67 to abut opposite sides of the circular opening 67, and correspondingly the effect of the spring 59 is limited by the limited movement of the offset leg or portion 66 of the member 63.

Accordingly, when the operator pushes the handle 44 from the position designated 54 and toward the position designated 56, the handle engages the offset or abutment 64 on the member 63 and thus pivots the member 63 in the counterclockwise direction, as viewed in FIG. 3, and thereby places tension in the spring 59. The operator can hold the handle 44 in the position designated 56, to thereby cause the engine to run at its fastest speed since there is then maximum tension in the spring 37 to counter the effect of the air blowing on the vane 18. However, when the operator releases the handle 44, the spring 59 will force on the member 63 which in turn pulls through the leg 64 on the handle 44 to rotate the handle 44 in the clockwise direction and to the limit position of the leg 66 abutting the circumference of the circular opening 67. That is, the handle 44 will automatically return to the position designated 54 when the operator releases force on the handle 44.

FIG. 4 shows the details of the arrangement of some of the parts, though the bolt 48 and the handle 44 and the spring 59 are removed from FIG. 4, for simplification and clarity, but it will be seen that the base member 49 has a top surface 71 which can carry the indicia or markings 52 through 56, and FIG. 4 also shows the offset portions described in connection with the member 63, and it further shows an offset portion 72 which is on the cover 51 and which extends into the retracted path of the handle 44 to limit the retracted position of the handle 44. Also, FIG. 4 shows a rivet 73 which is secured to the cover 51 and which provides the mounting for the bolt 48 and for the pivotal stop member 63.

Thus, the spring 37 urges the member 18 toward a position corresponding to the open throttle position, and the interconnector of the wire 38 controls the tension in the spring 37. There is thus an operator-controlled mechanism, including the handle 44 and the cable 38 and the plate 34 which are interconnected as shown and described and are all connected therefore with the spring 37. The stop member 63 has its offset legs to be disposed in the path of the movement of the handle 44 and against the abutments designated 74 and which are at diametrically opposite sides of the circular opening 67 in the plate 51. Further, the arrangement is such that when the plate 34 is pivoted counterclockwise, as viewed in FIG. 2, the end 41 of the spring 37 will abut the opening 42 in the plate 34 and thus cause the spring 37 to act as a link member and urge the vane member 18 in the clockwise direction about its pivot mounting 19 and thus correspondingly urge the throttle plate 21 in the counterclockwise direction.

FIG. 5 shows another arrangement where actually two handles or the like would be utilized for setting the control mechanism, rather than the single handle 44. Accordingly, it will be understood that FIG. 5 shows a bracket 81 which could be connected to the handle 13 say in the position of the mounting member 16 or somewhere along the handle 13. Also, a control rod or member 82 is shown fragmentarilly and it will be understood that that member extends to a position say toward the top of the handle 13 and thus available to the operator to control, and the rod or connector 82 thus extends to a position remote from the bracket 81 and thus the embodiment in FIG. 5 shows two separate controls or handles for setting the mechanism shown and described in connection with FIG. 5.

Thus, the embodiment of FIG. 5 has a first lever or control member 83 pivotally mounted on a pin 84 supported in the bracket 81, and it has a second control member 86 also pivotally mounted on the pin 84. Further, the Bowden wire 38 is shown, and it is suitably mounted to the bracket 81 at the location designated 87, and it has its end 88 extending into a connection with the lever or control member 86, as shown. Further, the member 83 and 86 are operatively interconnected such that the member 83 has a tang 89 extending into abutment or contact with the lever 86, on one side of the lever 86, and there is a spring 91 which is wrapped around the pivot pin 84 and has one end 92 anchored with the bracket 81 by extending through an opening therein, and the spring has its other end 93 extending in abutment with the edges of both control members 83 and 86, as shown. Of course it will be also noticed that the spring 91 is on the far side of the bracket 81 which has a slot 94 to receive the extending end of the spring 93 which can therefore move back and forth in the slot 94.

With that arrangement, the control member or lever 83, which is also a handle, can pivot about the pin 84 and between the abutments or stops 96 and 97 on the bracket 81. In the position adjacent the stop 96, the bracket 81 would indicate a "fast" engine condition, and also at the location designated 99, the bracket 81 could have an indication of a "slow" engine condition, and at a location designated 101 on the bracket 81 there could be a "stop" engine condition indicated. Further, the spring end 93 can abut the bracket edge 102 which thus serves as a stop with the spring end 93 and relative to the control member or lever 86.

Accordingly, setting the lever 83 in any selected position, the lever will be retained in that position, due to sufficient frictional resistance of either the lever 83 with the bracket 81 or of the frictional resistance in the conventional Bowden wire 38. However, upon actuation of the connector 82, the lever 86 will move in either direction about the longitudinal axis of the pivot pin 84, and such movement will be impressed upon the lever 83, at least to the extent of the positioning of the lever 83 against the bracket stop 96, in that direction. When the lever 86 is urged beyond the position mentioned, that is the spring end 93 will be further urged toward its stop 102, the lever 83 will not move but will retain whatever selected position it had between the positions marked 98 and 99. However, the aforementioned additional movement of the lever 86, that is toward the so-called third position and away from the "slow" or "stop" position, the lever 86 will override the lever 83 and force against the spring 91 but move the Bowden wire end 88 to thus give the faster or burst speed to the engine, as described in the aforementioned. Again, when the control 82 is released by the operator, the spring 91 will automatically return the lever 86 to a position such as that shown in FIG. 5, and that of course will again withdraw the Bowden wire end 88 and position the mechanism in a position so that the engine speed will be slower and will actually be back to whatever speed was established by the selected and aforesaid position of the lever 83.

With the embodiment of FIG. 5, the engine speed can be set by the lever 83, and that would be anywhere between a "slow" and a "fast" setting. Subsequently, when the operator desires a burst of speed or faster speed, then actuation of the control 82, through its handle which would be located remote from the lever 83 and is unshown but would be of any conventinal push-pull or lever arrangement, then the engine will run faster until the operator releases the control 82 and thus permits the spring 91 to return the lever 86 to its aligned position with the lever 83, and that will automatically return the engine to whatever speed the lever 83 had been previously set in. Accordingly, after the burst of power is applied, the control mechanism will always return to whatever position had been previously selected and established with regard to the lever 83. As such, the levers 83 and 86 are the control members which are operatively connected together in a fixed relation in the direction toward the first or "slow" position of setting, and they are inter-related by means of the spring 91 with regard to the direction of movement toward the "fast" position, but only the lever 86 can proceed beyond the "fast" position, as described.

What is claimed is:

1. In a governor control for an internal combustion engine, an engine, a pivotally mounted throttle plate movable between open and closed positions, a member movably mounted for movement in self-response to the speed of the engine and being operatively connected with said throttle plate for moving said throttle plate relative to said open and closed positions, a tension spring operatively connected with said member for yieldingly urging said member toward a position corresponding to the open throttle position, an operator-controlled mechanism connected with said spring and thereby be operatively connected with said throttle plate for manually moving said throttle plate toward the open and closed positions, the improvement comprising said operator-controlled mechanism including a movably mounted control mechanism having a first position corresponding to a fast engine speed and having a second position corresponding to a slow engine speed, said control mechanism being free of restriction and movable away from the slow engine speed position and having a third position which is located past the fast engine speed position and which corresponds to an engine speed faster than the fast engine speed, and an additional spring operatively connected with said control mechanism for yieldingly urging said control mechanism from said third position toward second position.

2. The governor control for an internal combustion engine as claimed in claim 1, including a stop member disposed in the path of movement of said control mechanism for limiting movement of said control mechanism beyond the third position.

3. The governor control for an internal combustion engine as claimed in claim 2, wherein said stop member is movably mounted, abutments disposed in the path of movement of said stop member for limiting movement of said stop member in both directions of movement of said control mechanism, and said spring for said control mechanism being connected with said stop member.

4. The governor control for an internal combustion engine as claimed in claim 2, wherein said self-responsive member includes an air vane disposed adjacent the engine to be blown thereby in the operation of the engine, said tension spring being connected with said self-responsive member and with said operator-controlled mechanism for resisting the blowing of said air vane, and said control mechanism including an operator handle and a movable interconnector with the latter connected between said tension spring and said handle for establishing the tension on said tension spring counter to the tension thereon induced by the self-responsive said air vane.

5. The governor control for an internal combusion engine as claimed in claim 1, wherein said movably mounted control mechanism includes an operator handle and an extended interconnector operatively connected with said tension spring for remote control of the position of the said self-responsive member.

6. The governor control for an internal combustion engine as claimed in claim 1, wherein the said self-responsive member and said operator-controlled mechanism have spring connection locations thereon and with said locations being spaced apart when the said self-responsive member and said operator-controlled mechanism are in positions corresponding to said second position of said control mechanism, said tension spring being a coil spring connected at said spring connection locations, and said coil spring having a free-body length of an extent at least that of the space between said locations and thereby being capable of urging the said self-responsive member away from said operator-controlled mechanism.

7. The governor control for an internal combustion engine as claimed in claim 6, including a link connected with the said self-responsive member and operatively connected with said throttle plate for positioning said throttle plate in accordance with the position of the said self-responsive member.

8. The governor control for an internal combustion engine as claimed in claim 1, including a stop member operatively interposed between said control mechanism and said spring for said control mechanism and being connected with said spring for said control mechanism for urging said control mechanism away from said third position, and an abutment disposed in the path of movement of said control mechanism in the direction away from said third position, for limiting the effect of said spring for said control mechanism in that said direction away from said third position.

9. A governor control for an internal combustion engine, comprising an engine, a pivotally mounted throttle plate movable between open and closed positions, a member movably mounted for movement in self-response to the speed of the engine and being operatively connected with said throttle plate for moving said throttle plate relative to said open and closed positions, a tension spring operatively connected with said member for yieldingly urging said member toward a position corresponding to the open throttle position, an operator-controlled mechanism connected with said spring to be operatively connected with said throttle plate for manually moving said throttle plate toward the open and closed positions, said mechanism including a movably mounted control member positionable in a first position corresponding to a fast engine speed and positionable in a second position corresponding to a slow engine speed, said mechanism including an additional control member movably mounted and operatively connected with the first-mentioned said control member and being free to move relative to the slow engine speed position and to a third position which is located past the fast engine speed position and which corresponds to an engine speed faster than the fast engine speed and a spring operatively interconnecting said control members for yieldingly urging said additional control member from said third position toward said second position.

10. The governor control for an internal combustion engine as claimed in claim 9, wherein said additional control member is operatively connected with said tension spring, a connector connected with said additional control member for positioning the latter, and with said connector extending to a location remote from the location of the first-mentioned control member.

11. The governor control for an internal combustion engine as claimed in claim 10, wherein said control members are operatively connected together in a fixed relation for unitary movement in the direction toward said first position, and, through their interconnecting said spring toward said second position, such that said additional control member is spring-urged away from said third position and to the selected position of the first-mentioned said control member.

* * * * *